US009572445B2

(12) United States Patent
Weist et al.

(10) Patent No.: US 9,572,445 B2
(45) Date of Patent: Feb. 21, 2017

(54) FLOATING FOAM BEVERAGE HOLDER

(71) Applicants: Matthew David Weist, Denver, CO (US); Jerry Lynn Allmendinger, Highland Village, TX (US)

(72) Inventors: Matthew David Weist, Denver, CO (US); Jerry Lynn Allmendinger, Highland Village, TX (US)

( * ) Notice: Subject to any disclaimer, the term of this patent is extended or adjusted under 35 U.S.C. 154(b) by 0 days.

(21) Appl. No.: 14/335,925

(22) Filed: Sep. 30, 2014

(65) Prior Publication Data

US 2015/0041476 A1 Feb. 12, 2015

Related U.S. Application Data

(60) Provisional application No. 61/858,657, filed on Jul. 26, 2013.

(51) Int. Cl.
*A47G 23/02* (2006.01)
*B65D 81/38* (2006.01)

(52) U.S. Cl.
CPC ..... *A47G 23/0216* (2013.01); *B65D 81/3879* (2013.01); *A47G 2200/02* (2013.01)

(58) Field of Classification Search
CPC . A47G 23/0216; A47G 23/0208; A47G 23/02
USPC ..... 220/560, 739, 737, 628, 603; 441/32, 1
See application file for complete search history.

(56) References Cited

U.S. PATENT DOCUMENTS

| | | | | |
|---|---|---|---|---|
| 1,838,086 | A * | 12/1931 | Farnstrom | A47C 15/006 441/131 |
| 4,927,041 | A * | 5/1990 | Hepburn | 220/560 |
| 5,727,709 | A * | 3/1998 | Nobile | 220/560 |
| 6,016,933 | A * | 1/2000 | Daily et al. | 220/560 |
| 6,244,066 | B1 * | 6/2001 | LaRose | 62/457.7 |
| 6,253,950 | B1 * | 7/2001 | Buck | B65D 81/3816 220/560 |
| 6,607,090 | B1 * | 8/2003 | Doerr | 220/560 |

* cited by examiner

*Primary Examiner* — Robert J Hicks
(74) *Attorney, Agent, or Firm* — Andrew F. Young, Esq.; Lackenbach Siegel, LLP

(57) ABSTRACT

A flotation device used to house beverages above a water surface that the user is occupying. The main body will be made from polyethylene (PE) or copolymer foam, with connector arms made of plastic attached to additional floatation balls (made of polyethylene or copolymer foam) all intended to keep the beverage holder above the water surface. Alternative versions include an attachment to a user to prevent floating separation between device and user. In kit form the flotation device has four connector arms each with a flotation ball at one proximate end thereof and the distal end thereof being secured to the beverage holder.

1 Claim, 10 Drawing Sheets

FLOATING FOAM BEVERAGE HOLDER

CROSS REFERENCE TO RELATED APPLICATION

This application relates to and claims priority from Ser. No. 61/858,657 filed Jul. 26, 2013.

BACKGROUND OF THE INVENTION

Field of the Invention

The present invention relates to a flotation device for a beverage made of polyethylene or copolymer foam utilized in pools, lakes, and other water sources (lazy rivers, water rides, oceans, etc.).

The invention includes enough space in the hollowed chamber ("canister") portion to hold a beverage (in several forms-cans, bottles, glasses) above the surface of the water, allowing for the beverage to stay cool, while allowing the consumer to continue floating in the current water source.

The invention includes additional features as noted below: Including, plastic stick connectors that facilitate the connection of the canister to additional floats; and additional circular floats (in the shape of balls) connected to the canister via the plastic stick connectors.

The invention has a unique design never seen in the market place before. The unique design includes sticks and the inclusion of floating polyethylene foam balls roughly two and a half to three inches in diameter to assist in flotation as well as keeping the beverage above the surface of the water. Along with function use, the balls/sticks add a certain aesthetic to the overall design of the device.

This invention generally relates to floating beverage holders for use by those who are engaged in water activities. People who are engaged in water activities in pools, spa, oceans, lakes or rivers often have a desire to keep a single beverage cold and nearby in the water. Several inventions have been developed to keep several drinks or food nearby (coolers), but very few exist for a single beverage. Previously, products have included inflatable single beverage holders, and the like for holding beverages nearby in the aquatic environment, but have not focused on the particular function of keeping the beverage cold, nor have they focused on keeping the beverage above the surface of the water. Flotation devices are well known and have been in use for many years. The present invention better serves the purpose for which it is intended, and constitutes a significant advance in the art as well as providing the consumer with the opportunity to maintain a cold beverage while staying within the confines of the water. The aforementioned floating beverage holder is essentially tip-proof for any single cans, bottles (plastic or glass), or glasses. The floating beverage holder is also an excellent insulator, due in part to the type of foam utilized to create the beverage holder housing as well as the flotation function, keeping the beverage above the surface of the water.

While beverage holders are known of, it may be desirable to provide a beverage holder that would float in a body of water, such as a swimming pool, spa, ocean, lake, or river while maintaining a cold temperature of that given beverage. Typical insulation devices do a good job of maintaining a cold beverage, but fail to provide a platform that would allow a beverage to float while confined within the water.

Both problems, i.e., keeping the beverage afloat while maintaining the cold temperature can be solved with this invention. Due to the nature of activities described herein, the beverage would be consumed outdoors where temperatures typically tend to be warmer than that of the beverage. With the effectiveness of the material used in the invention, and the general design keeping the main housing of the device above the water surface, the beverage can stay colder for longer than not having an insulation device provided by the non-floating insulation devices. Further, the ability to float is further exemplified by the design and the ability to maintain stability despite severe disruption, whether via the water or the consumer. Prior devices could not provide the stability, but the design of this invention enables a flotation device that is essentially tip-proof in many circumstances.

ASPECTS AND SUMMARY OF THE INVENTION

The invention described here vastly improves the way that beverages are consumed while consumers are within the confines of the water, whether that be in a pool, spa, ocean, lake, or river. Advantages include the insulation properties as well as the ability to remain stable and atop the surface of the water while floating in just about any circumstance presented within the water. The design with the extended arms including the additional floats provides for the much discussed stability. Furthermore, the design maintains the buoyancy required to keep the beverage above the water and well insulated to ensure the beverage remains cold.

In the broader sense, the invention described herein is developed with a insulating and buoyant material utilized in a hollowed chamber with a closed based and an open topside allowing for the insertion of a beverage. This design provides the necessary insulation as previously described to assist in the cold preservation of the beverage.

In any and all versions of the invention, four symmetrical holes are punctured through the base compartment to allow for entrance of connector sticks. Four connector sticks protrude outward from the base and connect to four additional floats, in the shape of a ball for additional float support. When the beverage is held within the hollowed chamber, and the connector sticks are connected to the base and simultaneously to the float balls, the device becomes vastly more stable than any prior floating beverage holder known of. This stability will ensure that even in more extreme circumstances, the beverage holder will not tip over, spilling the beverage or allowing water within the beverage top opening.

BRIEF SUMMARY OF INVENTION

Having succinctly characterized the general nature of the aforementioned invention, it is a primary object to provide an foam floating beverage holding device which shall simultaneously maintain the preservation of a cold beverage at an acceptable temperature and allowing the user to place the holding device down in water without spillage from the container while maintaining a stable platform, that sits atop the surface of the water, for the consumer.

Another object of the present invention to provide a foam floating beverage container holding device which is devised and produced to have ample buoyancy and stability to remain upright even in most extreme circumstances presented in rough water to prevent beverage from emptying from the container.

It is another object of the present invention to provide a foam floating beverage container holding device which has features of design and structure that provide for easy handle and grip, is inexpensive to manufacture and market, requires essentially no maintenance and is easy to carry to the preferred location.

These and other objects and advantages of the present invention will become more apparent from an understanding of the following detailed characterization of the present invention when considered with the accompanying drawings.

DETAILED DESCRIPTION OF THE PREFERRED EMBODIMENTS

FIGS. 1A, 1B, 1C, 1D, and 1E show the Floating Foam Beverage Flotation Device 200 is made from polyethylene (PE) or copolymer foam additional polyethylene or copolymer foam balls on four sides to float the device, and a hollowed chamber in the middle of the device to accommodate a beverage. The device is designed to ensure that the beverage maintains its cold temperature for longer periods, while also keeping the beverage upright, virtually creating a tip-proof flotation device.

Figure 2A:
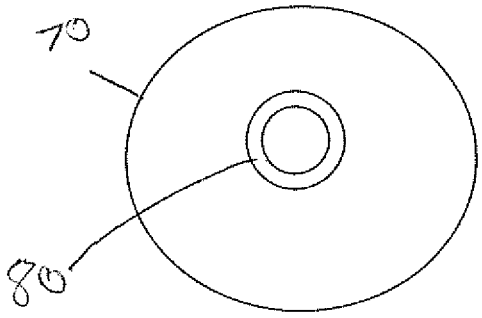
FIG. 2A is a floatation ball made from foam used on the end of a plastic stick to float the floating foam beverage holder noting a connection hole for sticks to insert into the floatation ball.
Figure 2B:
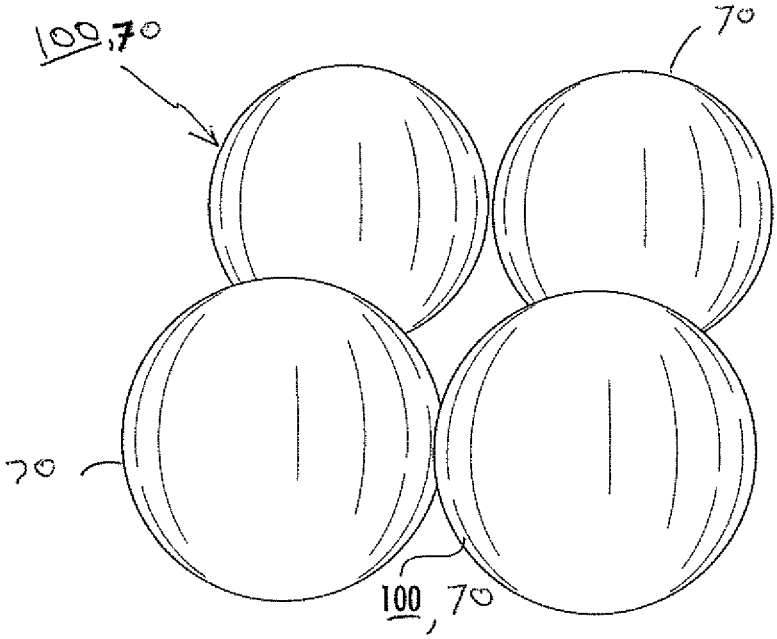
FIG. 2B is four flotation balls 70 made from polyethylene (PE) or copolymer. Each floatation ball 70 measures approximately two and a half to three inches in diameter.
Figure 3A:
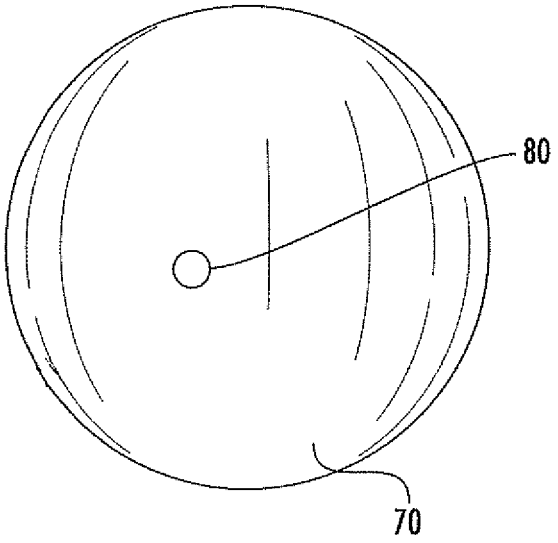
FIG. 3A is a detail of the flotation balls 70 made from polyethylene (PE) or copolymer. Each floatation ball 70 measures approximately two and a half to three inches in diameter.

FIGS. 2A, 2B, and 3A detail the flotation balls 70 made of polyethylene or copolymer foam with connector hole 80 for the connector sticks to complete the device for four connector sticks 60 extending from the hollowed chamber 10 and connecting to all four floatation balls as a group 100 of individual flotation balls 70. Each flotation ball 70 measures at approximately two and a half to three inches in diameter.

Figure 4A:
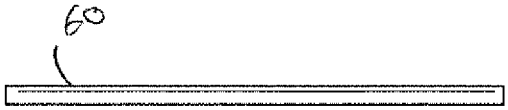
FIG. 4A details the connector stick 60 that is approximately four to five inches in length.
Figure 4B:
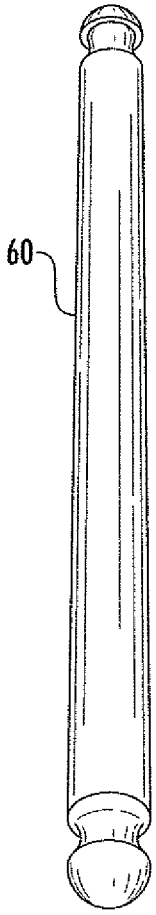
FIG. 4B also details the connector stick 60 that is approximately four to five inches in length.
Figure 5:
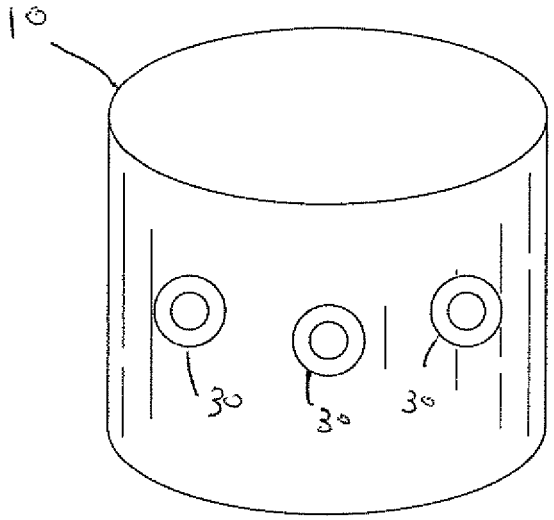
FIG. 5 is a hollowed chamber made from the polyethylene or copolymer foam utilized in the center of the floating foam beverage holder device to accommodate a beverage whether in can, bottle or cup form.
Figure 6:
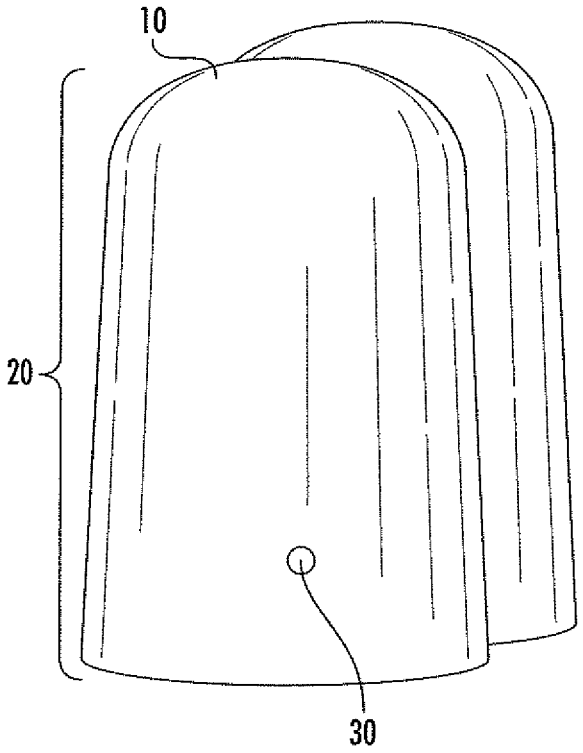
FIG. 6 details a hollowed chamber 10 where the material of the chamber is comprised of polyethylene or copolymer foam utilized in the foam floating beverage holder to accommodate a beverage whether in a can, bottle or cup form wherein the height 20 is approximately five to five and one quarter inches. The connection hole 30 is utilized to accept the connector stick 60 which extends out to connect the flotation balls.

FIGS. 4A and 4B details the connector stick 60 that is approximately four to five inches in length.

FIGS. 5, 7, 7A, and 7B detail views of the hollowed chamber 10 where the material of the chamber is comprised of polyethylene or copolymer foam utilized in the Foam Floating Beverage Holder 200 to accommodate a beverage 201 whether in can, bottle or cup form wherein the height 20 is approximately five to five and one quarter inches. The connection hole 30 is utilized to accept the connector stick 60 which extends out to connect to the flotation balls.

Figure 7A:
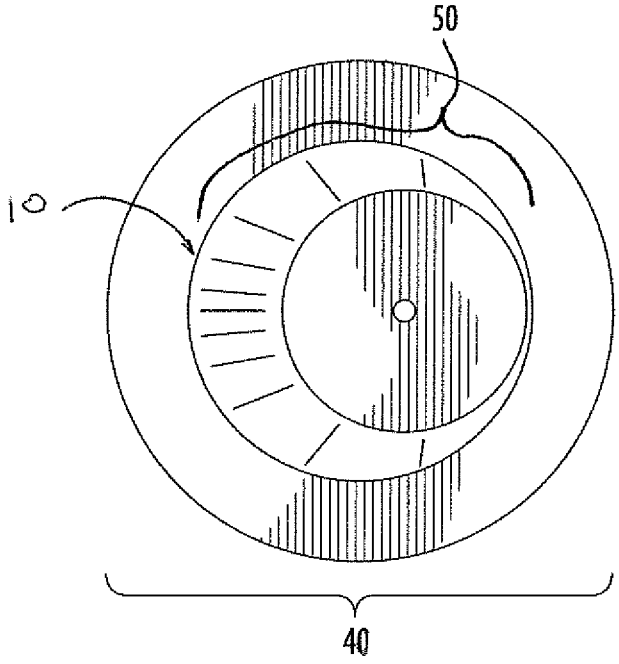
FIG. 7A is a top view perspective of the hollowed chamber 10 where the exterior diameter 40 is approximately three and a half to three and three quarters inches and the interior diameter 50 is approximately two and a quarter to two and a half inches in diameter.
Figure 7B:
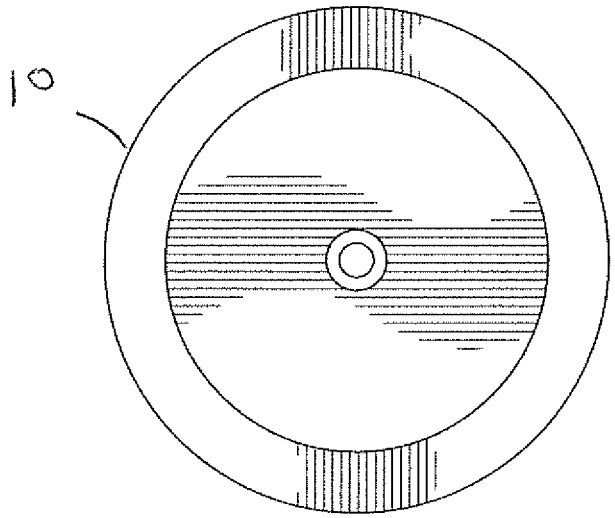
FIG. 7B is a top view of the hollowed chamber canister.

FIG. 7A is a top view perspective of the hollowed chamber 10 where the exterior diameter 40 is approximately three and a half to three and three quarters inches and the interior diameter 50 is approximately two and a quarter to two and a half inches in diameter.

Figure 8:
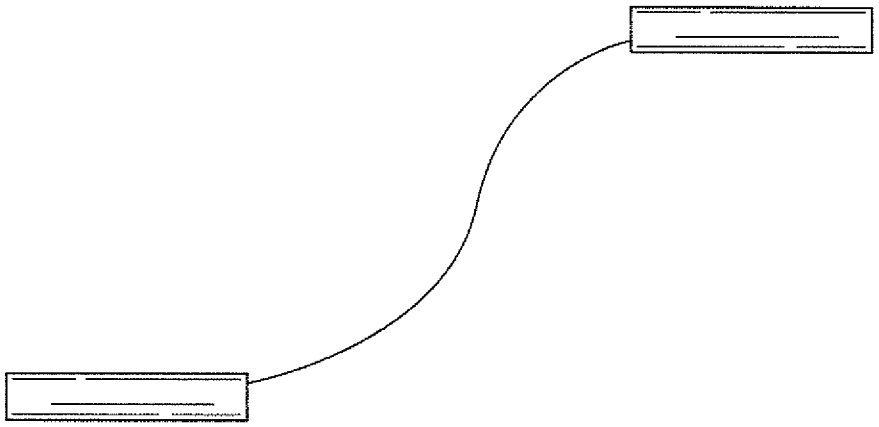
FIG. 8 is a leash to attach to the floating foam beverage holder to ensure the device does not float away from the consumer in the water source.

FIG. 8 shows a leash to attach to the floating foam beverage holder to ensure the device does not float away from the consumer in the water source.

Figure 9:
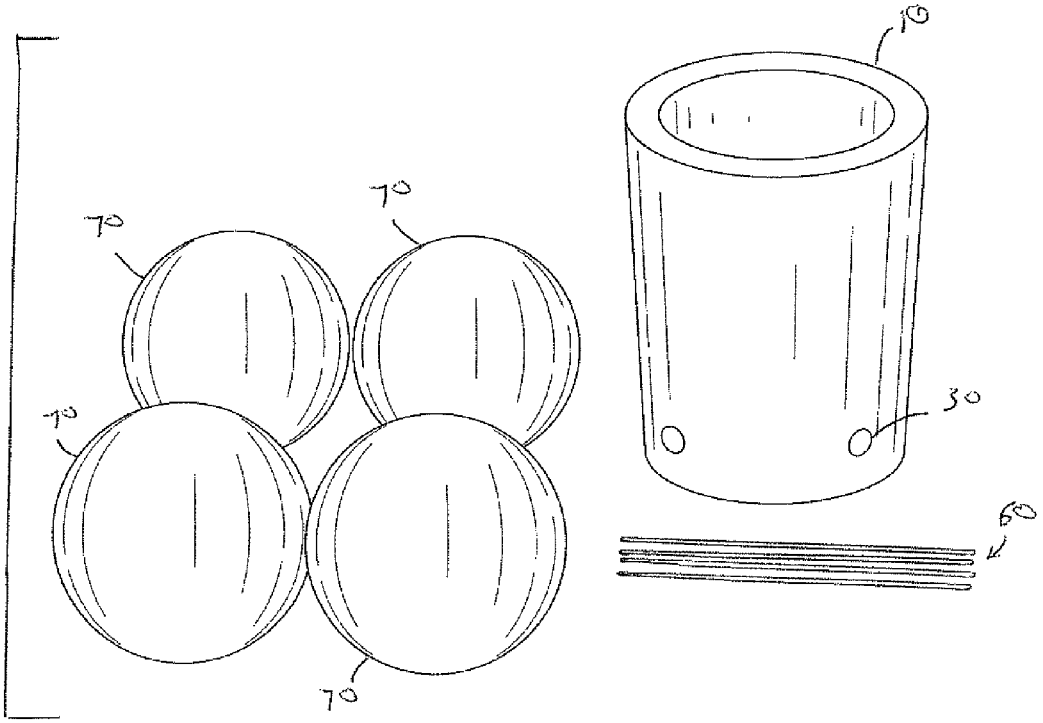
FIG. 9 details how the floating foam beverage holder device is delivered to the consumer.

FIG. 9 shows how the floating foam beverage holder device is delivered to the consumer.

HOW IT WORKS

Figure 1A:
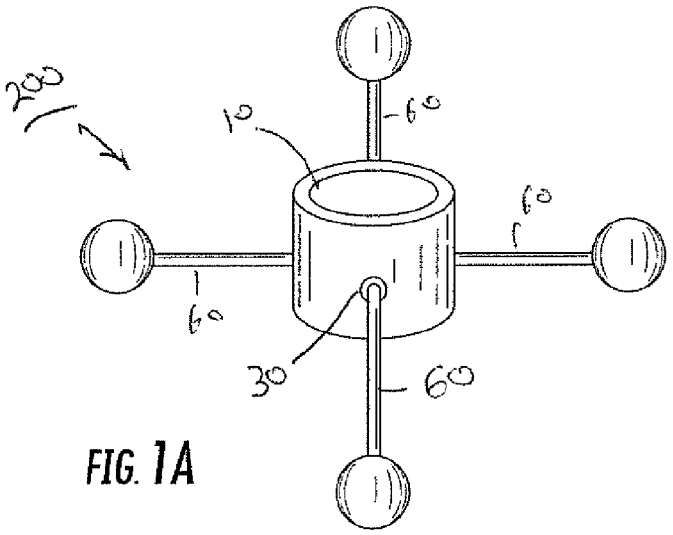
FIG. 1A is a floating foam beverage device made from foam utilizing additional foam balls on four sides connected via plastic connector arms to float the device, and a hollowed chamber in the middle of the device to accommodate a beverage.
Figure 1B:
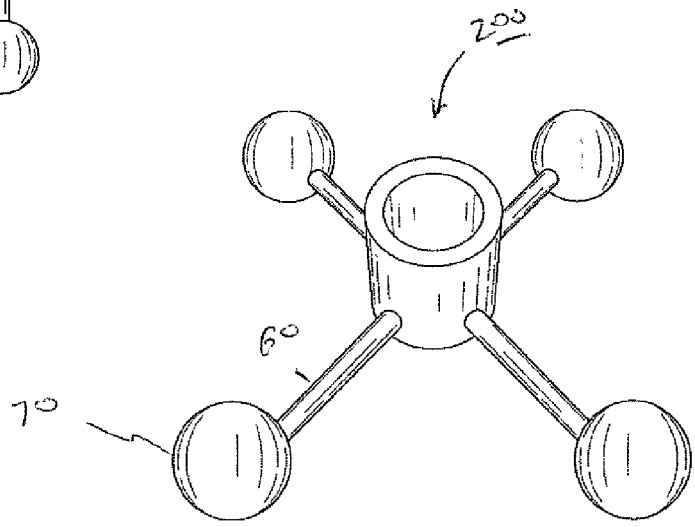
FIG. 1B is an image of the floating foam beverage device.
Figure 1C:
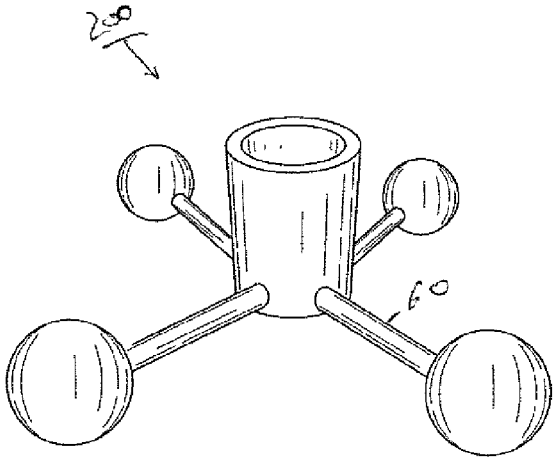
FIG. 1C is another image of the floating foam beverage device.
Figure 1D:
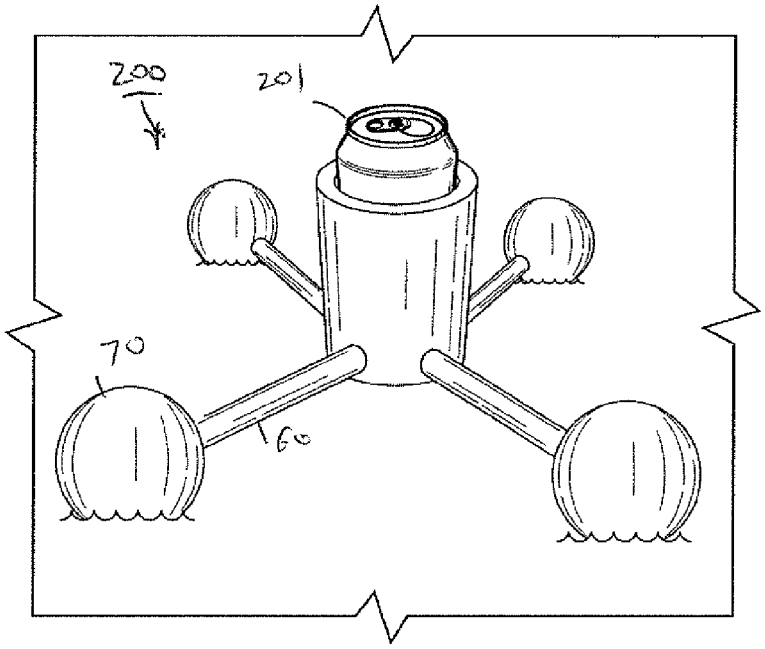
FIG. 1D displays the floating foam beverage device above the water while maintaining stability and providing an enclosed device to keep the beverage cold.
Figure 1E:
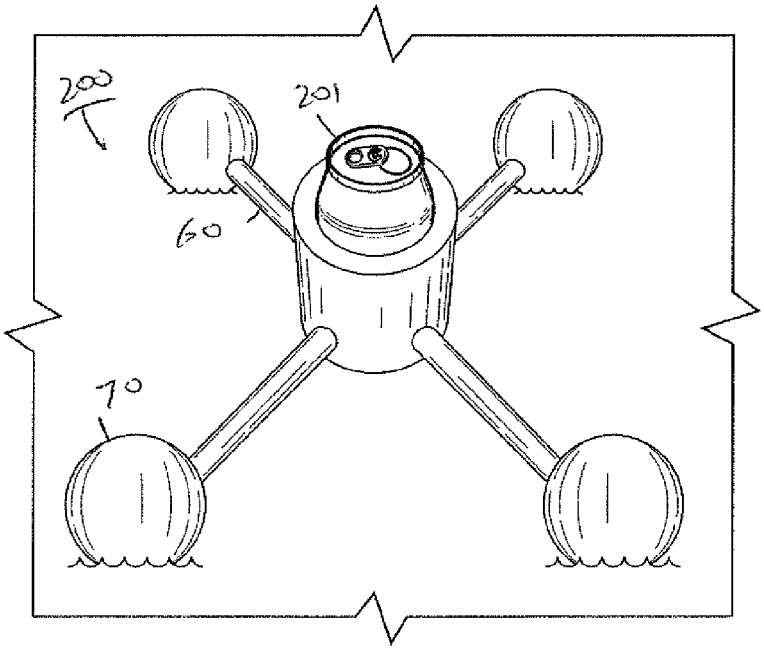
FIG. 1E displays another image of the floating foam beverage device above the water while maintaining stability and providing an enclosed device to keep the beverage cold.

FIG. 1D details how the Floating Foam Beverage Holder device 200 is delivered to the consumer, assembled while showing it floating in the water.

FIG. 9 shows each of the previous parts described above that comes to be assembled upon delivery to the consumer.

We claim:

1. A flotation device used to accommodate a single beverage container, comprising of a cylindrical chamber made from either Polyethylene ("PE") or copolymer foam, whereas one end is closed as a base, and an opposite end is open to accept a single beverage container;

the foam is for floating and insulation purposes; the base having four symmetrically placed holes punctured into the side of the base of the cylindrical chamber;

an auxiliary hole punctured directly from a top side through to a bottom side in a middle of the base;

four spherical floats made from either said PE or copolymer foam;

four connector arms made of thermoplastic used to connect to the base into the symmetrically placed holes and the spherical floats;

a strap connectable to a user and the device through the directly punched hole; and the device accommodating the single beverage container preserving a cold temperature of a single beverage container.

* * * * *